US011175050B2

(12) United States Patent
Luo et al.

(10) Patent No.: US 11,175,050 B2
(45) Date of Patent: Nov. 16, 2021

(54) HEATER

(71) Applicant: Hangzhou Xiaoyi E-commerce Co., Ltd., Hangzhou (CN)

(72) Inventors: Guo Ding Luo, Hangzhou (CN); Hua Huang, Hangzhou (CN); Fei Lu, Hangzhou (CN)

(73) Assignee: Hangzhou Xiaoyi E-commerce Co., Ltd., Hangzhou (CN)

( * ) Notice: Subject to any disclaimer, the term of this patent is extended or adjusted under 35 U.S.C. 154(b) by 0 days.

(21) Appl. No.: 17/167,840

(22) Filed: Feb. 4, 2021

(65) Prior Publication Data

US 2021/0172609 A1 Jun. 10, 2021

Related U.S. Application Data

(63) Continuation of application No. PCT/CN2020/133775, filed on Dec. 4, 2020.

(30) Foreign Application Priority Data

Dec. 4, 2019 (CN) ..... 201911226093.9
Dec. 4, 2019 (CN) ..... 201911230676.9
(Continued)

(51) Int. Cl.
*F24C 15/22* (2006.01)
*F24C 15/36* (2006.01)
(Continued)

(52) U.S. Cl.
CPC ..... *F24C 15/22* (2013.01); *F24C 3/14* (2013.01); *F24C 15/08* (2013.01); *F24C 15/36* (2013.01)

(58) Field of Classification Search
CPC ..... F24C 15/22; F24C 15/36; F24C 15/08; F24C 3/14; F23D 14/06; F23D 14/34
See application file for complete search history.

(56) References Cited

U.S. PATENT DOCUMENTS 4,082,993 A * 4/1978 Oakes ..... F17C 13/04 126/40
4,284,058 A * 8/1981 Lutz ..... F24C 3/14 126/38
4,588,373 A * 5/1986 Tonon ..... F24C 3/14 126/39 J
4,904,182 A * 2/1990 Leshner ..... F23D 14/60 431/354
(Continued)

FOREIGN PATENT DOCUMENTS

FR 2816395 A3 * 5/2002 ..... F24C 3/14
WO WO2009094677 A2 * 7/2009 ..... F23D 14/06

*Primary Examiner* — David J Laux
*Assistant Examiner* — Nikhil P Mashruwala
(74) *Attorney, Agent, or Firm* — Osha Bergman Watanabe & Burton LLP

(57) ABSTRACT

A heater includes a body, a burner assembly, a gas tank, and a reflecting plate. The burner assembly is installed on the body. The gas tank is arranged in the body and directly below the burner assembly, and has an interface end connected to a fuel inlet end of the burner assembly via a valve. The reflecting plate is installed in the body and located between the burner assembly and the gas tank. The reflecting plate prevents heat coming from a bottom portion of a burner of the burner assembly from being radiated directly to the interface end of the gas tank and allows heat coming from around the burner to be radiated to a periphery of the interface end of the gas tank and heat the gas tank.

10 Claims, 13 Drawing Sheets

(30) Foreign Application Priority Data

| | | |
|---|---|---|
| Dec. 4, 2019 | (CN) | 201922144654.2 |
| Dec. 4, 2019 | (CN) | 201922144655.7 |
| Dec. 4, 2019 | (CN) | 201922144661.2 |
| Dec. 4, 2019 | (CN) | 201922144687.7 |
| Dec. 4, 2019 | (CN) | 201922144691.3 |
| Dec. 4, 2019 | (CN) | 201922144714.0 |
| Dec. 4, 2019 | (CN) | 201922145117.X |
| Dec. 4, 2019 | (CN) | 201922145120.1 |
| Dec. 4, 2019 | (CN) | 201922145195.X |
| Dec. 4, 2019 | (CN) | 201922145216.8 |
| Dec. 4, 2019 | (CN) | 201922145218.7 |
| Dec. 4, 2019 | (CN) | 201922145259.6 |

(51) Int. Cl.
*F24C 15/08* (2006.01)
*F24C 3/14* (2006.01)

(56) References Cited

U.S. PATENT DOCUMENTS

| | | | | |
|---|---|---|---|---|
| 5,890,483 | A * | 4/1999 | Stevenson | F24C 3/14 126/85 R |
| 6,173,709 | B1 * | 1/2001 | Yokoyama | F23D 14/06 126/39 E |
| 6,446,623 | B1 * | 9/2002 | Resmo | F24C 1/12 126/92 R |
| 7,086,396 | B2 * | 8/2006 | Waters | F24C 1/12 126/92 AC |
| D680,799 | S * | 4/2013 | Chung | D7/337 |
| 10,488,052 | B2 * | 11/2019 | Kalyanaraman | F24C 3/04 |
| 11,002,448 | B2 * | 5/2021 | Hagstrom | F24C 3/08 |
| 2009/0223512 | A1 * | 9/2009 | Konkle | F24C 1/10 126/92 AC |
| 2020/0038641 | A1 * | 2/2020 | Smith | A61M 31/002 |

* cited by examiner

HEATER

CROSS-REFERENCE TO RELATED APPLICATIONS

This application is a continuation application of International Patent Application No. PCT/CN2020/133775 filed on Dec. 4, 2020, claiming priority rights of Chinese Patent Application Nos. 201911230676.9, 201911226093.9, 201922144661.2, 201922144687.7, 201922144691.3, 201922144714.0, 201922145195.X, 201922144655.7, 201922145259.6, 201922145117.X, 201922144654.2, 201922145218.7, 201922145216.8, 201922145120.1, filed on Dec. 4, 2019, the entire contents of which are incorporated herein by reference.

TECHNICAL FIELD

One or more embodiments of the present invention relate to the technical field of heating equipment, in particular to a heater.

BACKGROUND

According to fuel used, heaters may be divided into electricity-driven heaters and gas-driven heaters. For example, outdoor heaters are usually gas-driven heaters. A gas-driven heater generally includes a replaceable gas tank, a valve, a burner assembly, and a furnace body as an outer housing. For the purpose of maximizing firepower and minimizing volume, the gas tank, the valve, and the burner assembly are generally configured to be in the same longitudinal direction. When in use, the heat generated at the bottom of a burner of the burner assembly is easily radiated downwards to directly bake the valve and an interface end of the gas tank. Such a structure has safety hazards. At the same time, in order to increase a storage of the gas tank, gas stored inside is generally in a liquid or solid form under high pressure and low temperature, which easily comes short of full use due to relatively too low external pressure or relatively too low temperature during use. Particularly in plateau areas, there is a situation where nearly a quarter of the gas remains unused and cannot flow out, resulting in low fuel utilization and poor experience.

SUMMARY

In one or more embodiments of the present invention, provided is a heater designed to be capable of radiating heat generated by a burner to a periphery of an interface end of a gas tank while blocking a direct radiation to the interface end, thereby effectively improving the utilization rate of the fuel.

In one or more embodiments, the heater may include a body, a burner, a gas tank, and a reflecting plate. The burner assembly is installed on the body. The gas tank is arranged in the body and directly below the burner assembly, and has an interface end connected to a fuel inlet end of the burner assembly via a valve. The reflecting plate is installed in the body and located between the burner assembly and the gas tank. The reflecting plate prevents heat coming from a bottom portion of a burner of the burner assembly from being radiated directly to the interface end of the gas tank and allows heat coming from around the burner to be radiated to a periphery of the interface end of the gas tank and heat the gas tank.

In one or more embodiments, the reflecting plate may include a blocking area and a radiation area. The blocking area is a projection plane of the burner on the reflecting plate in a longitudinal direction and is configured to prevent the heat coming from the bottom of the burner from being radiated directly to the interface end of the gas tank. The radiation area does not overlap with the blocking area and is configured to allow the heat coming from around the burner to be radiated to the periphery of the interface end of the gas tank.

In one or more embodiments, the reflecting plate may be provided with at least one through hole, as the radiation area, that penetrates longitudinally and does not overlap with the blocking area. In some embodiments, the reflecting plate is further provided with a mounting slot.

In one or more embodiments, the body may include a furnace body and a mesh cover assembly. The furnace body is provided, at a lower opening, with a cavity for containing the mesh cover assembly.

In one or more embodiments, a lower end surface of the body may be provided with a plurality of sets of supporting legs and has an outer peripheral wall that is bent inward to form an annular support surface. An upper end surface of each of the supporting legs has an L-shaped connecting surface, including a longitudinal surface and a horizontal surface. The longitudinal surface abuts against the annular support surface. The horizontal surface abuts against the outer peripheral wall of the body and is fastened by a screw. The supporting legs limit a position of the mesh cover assembly contained in the cavity.

In one or more embodiments, the furnace body may further include a limiting assembly that limits the position of the mesh cover assembly. The limiting assembly may be a plurality of sets of L-shaped rotating rods pivotally connected to the upper end surface of the furnace body. Alternatively, the limiting assembly may include a plurality of sets of slotted holes arranged in the upper end surface of the furnace body, and the mesh cover assembly may have a bottom ring that is fixedly provided with clamping joints that match the slotted holes. When the slotted holes have a gourd shape or when the slotted holes are circular, the clamping joints have an outer circumference with external threads. The clamping joints extend into the slotted holes and are screwed with bolts. Alternatively, the limiting assembly may be a annular groove structure formed by an annular inner recess on the upper end surface of the furnace body, and the bottom ring of the mesh cover assembly, without head-to-tail connection, is embedded into the annular groove structure and clamped by a tension of the mesh cover assembly itself.

In one or more embodiments, the bottom ring of the mesh cover assembly, without head-to-tail connection, may be fixedly provided with a clamping joint. The limiting assembly includes an annual groove structure and a hole that matches the clamping joint. The bottom ring is embedded in the annular groove and clamped by the tension of the mesh cover assembly itself, and the clamping joint is assembled with the hole to facilitate the installation and positioning of the mesh cover assembly.

In one or more embodiments, the upper end surface of the furnace body may comprise an installation plane and a concave surface. The burner assembly has a lower end that is fixedly mounted on the installation plane and connected to the gas tank arranged in the cavity via the valve, and the concave surface is provided with at least one heat-passing hole that communicates with the cavity.

In one or more embodiments, the installation plane of the furnace body is fixedly provided with a support frame, which has an upper end that passes through the mounting slot of the reflecting plate and is clamped with the reflecting plate.

In one or more embodiments, the support frame is plate-shaped as a whole, and extended inward and outward to form an inner protrusion and an outer protrusion, respectively, and, in a longitudinal direction, the inner protrusion and the outer protrusion are arranged in a staggered manner up and down to clamp the reflecting plate and restrict a rotation of the support frame.

In summary, embodiments of the present invention provide the following advantage: the heater includes a body, a burner assembly, a gas tank and a reflecting plate, the reflecting plate allowing the heat generated by the burner to be radiated to the periphery of the interface end of the gas tank while blocking the direct radiation to the interface end, making it possible to fully use the fuel in the gas tank, avoiding the problem of wasting due to condensation inside the gas tank caused by the low temperature in the gas tank, thereby effectively improving the fuel utilization rate, especially for areas with low air pressure such as plateaus.

DETAILED DESCRIPTION

Figure 1:
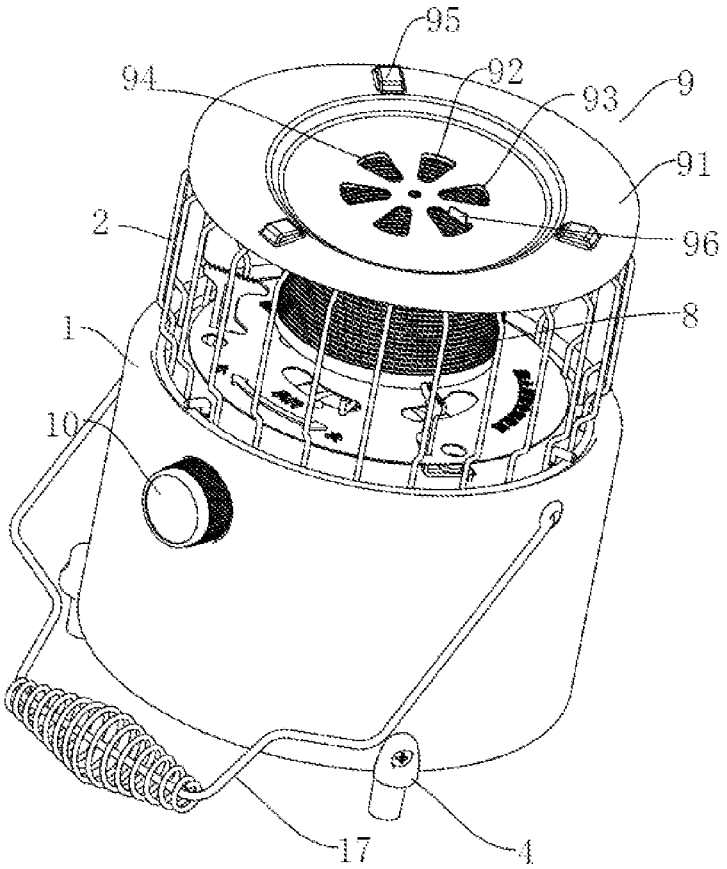
FIG. 1 is a perspective view of a heater according to one or more embodiments.

Embodiments of the present invention will be described hereafter through specific and detailed examples. Those skilled in the art will easily appreciate other advantages and effects of the present invention from the disclosure herein. The present invention can also be implemented or applied through other different specific embodiments, and various details in this description can also be modified or changed in various ways based on different viewpoints and applications without departing from the spirit of the present invention. It should be noted that the following embodiments and the features in the embodiments can be combined with one another where there is no conflict.

It should be noted that the illustrations provided in the following embodiments only illustrate the basic idea of the present invention in a schematic manner. Instead of the number, shape and size of the components that are adopted during the actual implementation, the figures only show the components related to the present invention. During actual implementation, the type, quantity, and ratio of each component can be changed at will, and the layout of the components may also be more complicated.

All directional indications (such as up, down, left, right, front, back, horizontal, vertical . . . ) in the embodiments of the present invention are only used to explain the relative positional relationship, movement, etc., of the components in a specific posture. If the specific posture changes, the directional indications will also change accordingly. It is defined that the up-down direction shown on the paper sheet of FIG. 2 is the up-down direction in the present invention, and the direction from the mesh cover assembly to the burner on the paper sheet is defined as the direction from outside to inside.

As shown in FIGS. 1-17, a heater includes a body, a burner assembly 5, a gas tank 6, and a reflecting plate 3. The burner assembly 5 is installed on the body. The gas tank 6 is arranged in the body and directly below the burner assembly 5, with an interface end connected to a fuel inlet end of the burner assembly 5 via a valve 7. The reflecting plate 3 is installed in the body and located between the burner assembly 5 and the gas tank 6, to prevent heat coming from a bottom portion of a burner 51 of the burner assembly 5 from being radiated directly to the interface end 61 of the gas tank 6, and to allow the heat around the burner 51 to be radiated to a periphery 62 of the interface end 61 of the gas tank 6 and heat the gas tank 6.

Figure 2:
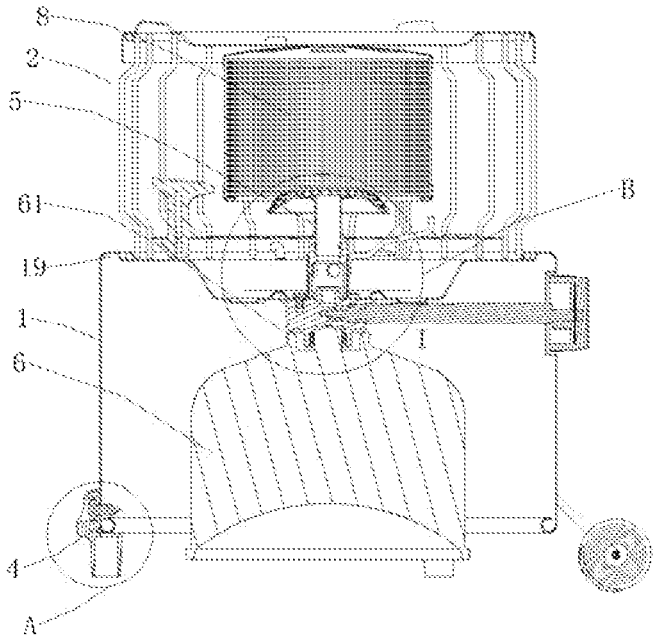
FIG. 2 is a cross-sectional view of a heater according to one or more embodiments.

As shown in FIG. 2, the body includes a furnace body 1 and a mesh cover assembly 2 that is detachably installed on the furnace body 1. An adjustment switch 10, through which the gas output of the gas tank 6 is controlled, is provided on the furnace body 1. A cavity (not illustrated in the figures) that is capable of containing the mesh cover assembly 2 is provided at a lower opening of the furnace body 1. The cavity is also used for containing the gas tank 6 when in use. During packaging and shipping, the mesh cover assembly 2 is disposed within the cavity to reduce the overall volume of the package, so as to save the cost of packaging and shipping. In order to limit the position of the mesh cover assembly 2 contained in the cavity and to avoid the mesh cover assembly 2 from coming out of the cavity, the furnace body 1 also includes a limiting assembly or a supporting leg 4. The limiting assembly may be a fastener that is provided on the upper end surface of the furnace body 1. The fastener passes through the upper end surface of the furnace body 1 and is fixedly connected to the mesh cover assembly 2. Other structures may also be used to limit the position of the mesh cover assembly 2.

As shown in FIGS. 2 and 4-6, the supporting leg 4, which is made of a rubber material, is fixed to the lower end surface of the furnace body 1. In this embodiment, the supporting leg 4 is provided in three sets fixed circumferentially on the lower side of the furnace body 1. The supporting legs 4 not only serve as limiting components for the mesh cover assembly 2 placed in the cavity, but also serve as supporting components to support the heater. In this embodiment, the supporting legs 4 are specifically connected to the furnace body 1, so that an outer peripheral wall of the lower end surface of the furnace body 1 is bent inward to form an annular support surface 18. The annular support surface 18 has a cross-section that is in the shape of a "C" in the axial direction of the furnace body 1. Indeed, the shape of the annular support surface 18 may be adjusted according to the process or actual needs. Each of the supporting legs 4 is provided, on the upper end surface, with an L-shaped connecting surface that includes a longitudinal surface 41 and a horizontal surface 42. The horizontal surface 42 abuts against the annular support surface 18, and the longitudinal surface 41 abuts against the outer peripheral wall of the furnace body 1 and is fastened by the fastener, which facilitates the disassembly and assembly of the two and is easy to realize. The fastener may be a screw.

In one or more embodiments, the longitudinal surface 41 is provided with a first screw hole 43, the horizontal surface 42 is provided with a second screw hole 44, and the annular support surface 18 is provided with a third screw hole (not illustrated in the figures) that is opposite to the second screw hole 44 for spare use. The supporting leg 4 is also provided with a first receiving groove 45 for containing the fastener at a position behind the first screw hole 43 and a second receiving groove 46 for containing the fastener at a position below the second screw hole 44. In the connection between the supporting leg 4 and the furnace body 1, to enhance the overall structural strength, the first screw hole 43 is first considered to be assembled with the screw hole that is provided on the outer peripheral wall of the furnace body 1. When the supporting leg 4 is installed on the furnace body 1 in the above manner, after the installation is not firm enough or flattened, the second screw hole 44 and the third screw hole are considered to be used for assembly.

Figure 3:
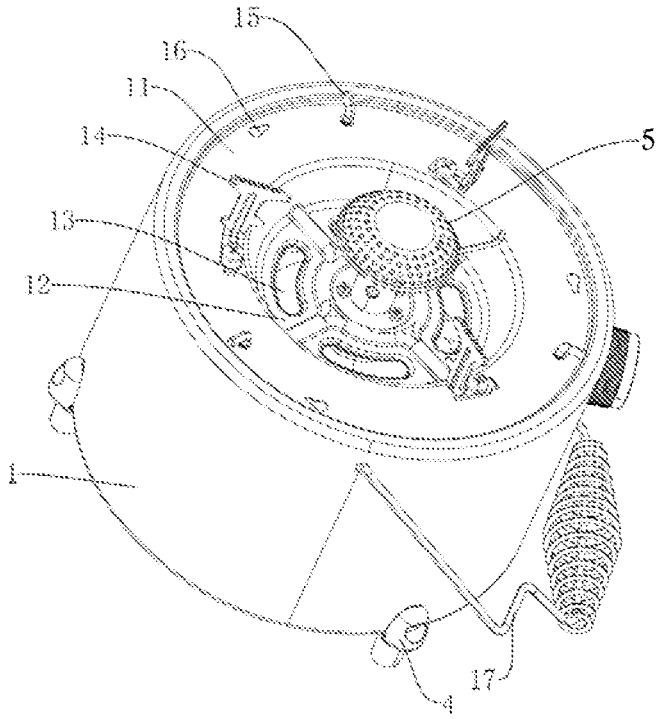
FIG. 3 is a perspective view of a heater according to one or more embodiments, omitting the mesh cover assembly, the heating cover and the reflecting plate.
Figure 4:
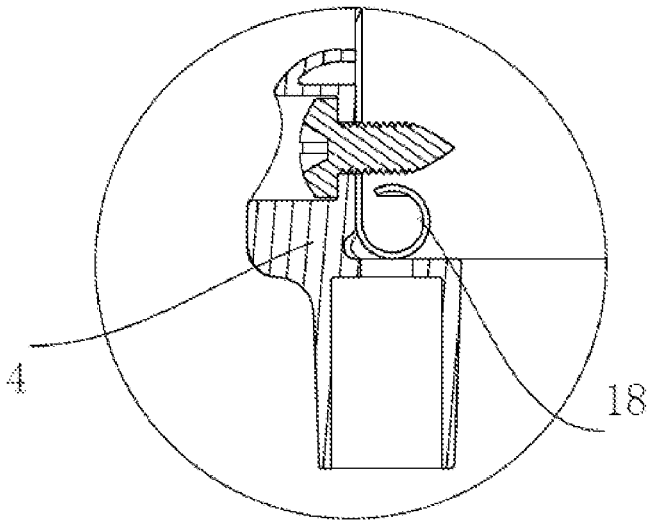
FIG. 4 is an enlarged schematic diagram of A in FIG. 2.
Figure 5:
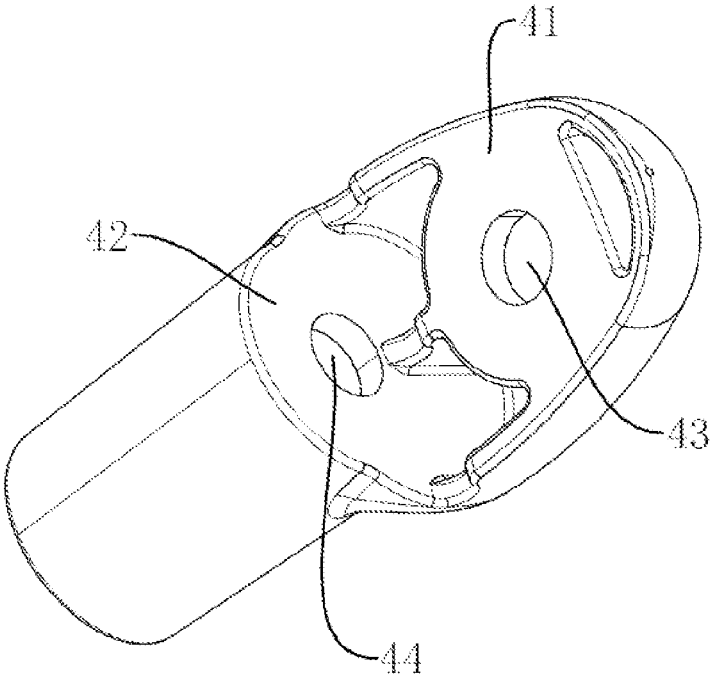
FIG. 5 is a perspective view of a supporting leg of a heater according to one or more embodiments.
Figure 6:
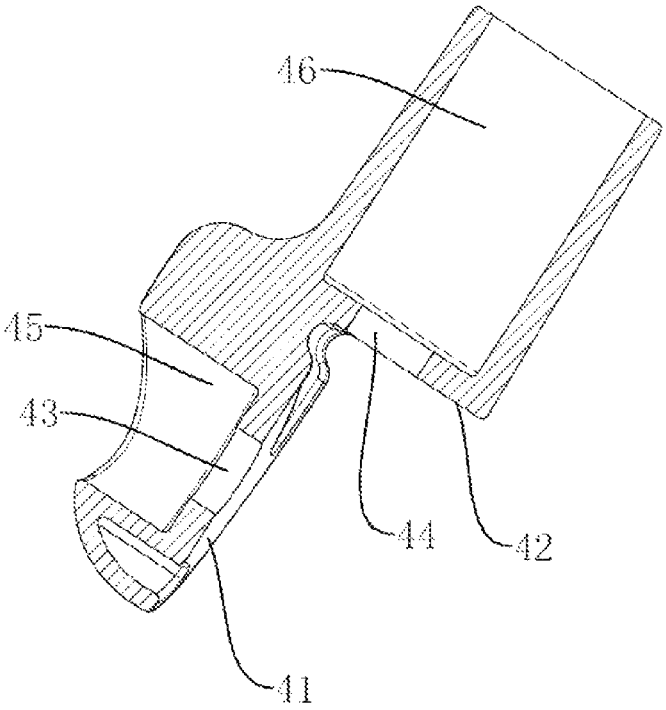
FIG. 6 is a cross-sectional view of a supporting leg of a heater according to one or more embodiments.

As shown in FIGS. 2 and 3, the upper end surface of the furnace body 1 comprises an installation plane 11 and a concave surface 12 that forms a cavity. The mesh cover assembly 2 is mounted on the installation plane 11. The limiting assembly limits the mesh cover assembly 2 to the installation plane 11, which is provided on the upper end surface of the furnace body 1, so that the mesh cover assembly 2 can be conveniently limited and mounted on the upper end surface of the furnace body 1, in order to meet the purpose of being detachable and not easy to come out when used. The upper end surface of the furnace body 1 is also provided with a raised ring-shaped limiting block 19. The circular area enclosed by the ring-shaped limiting block 19 has a diameter not less than the outer diameter of the lower end surface of the mesh cover assembly 2, to further limit the outward movement of the mesh cover assembly 2 after it is placed on the upper end surface of the furnace body 1.

Figure 7:
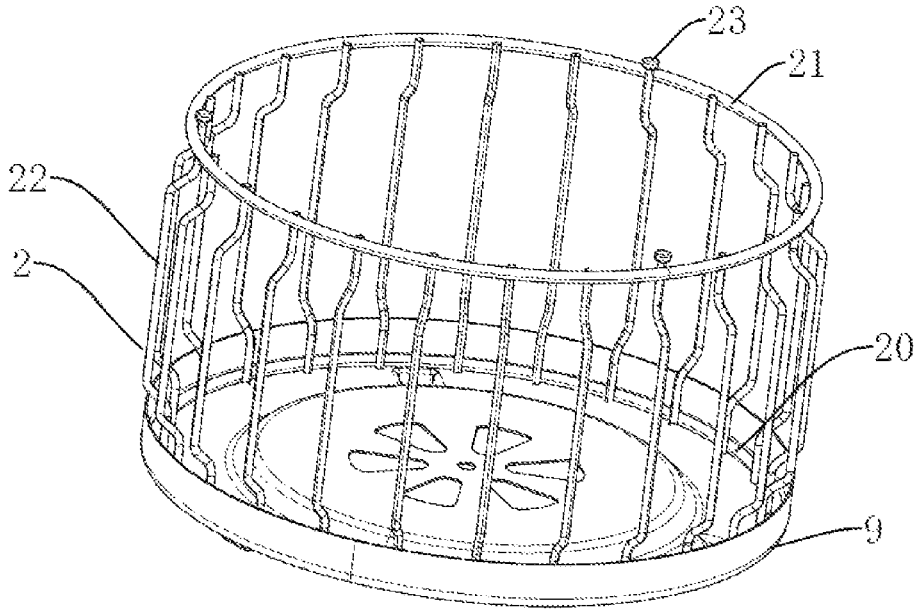
FIG. 7 is a perspective view of a mesh cover assembly of a heater according to one or more embodiments.
Figure 8:
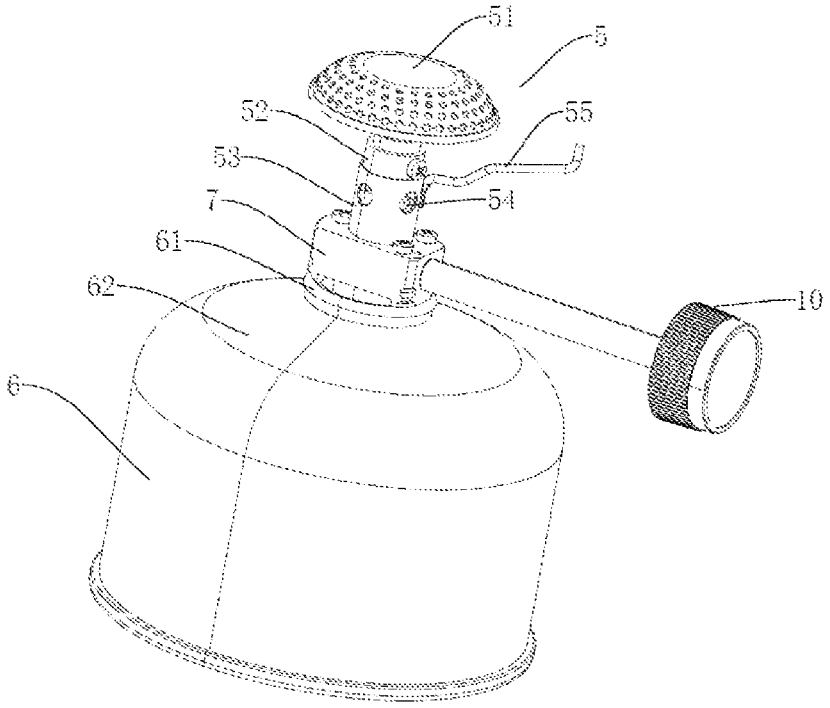
FIG. 8 is a perspective view of a gas tank and a burner assembly of a heater according to one or more embodiments.
Figure 9:
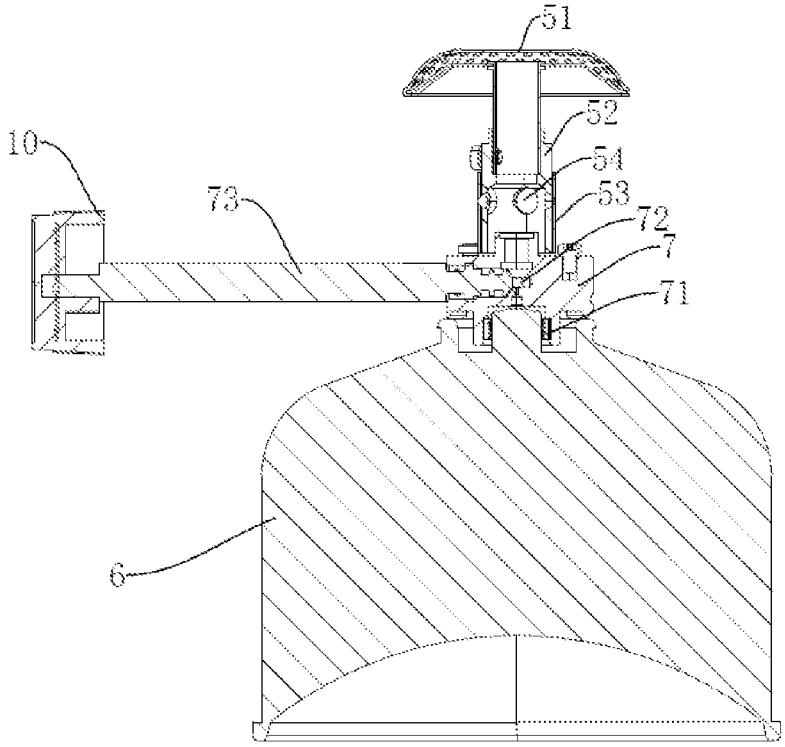
FIG. 9 is a cross-sectional view of a gas tank and a burner assembly of a heater according to one or more embodiments.
Figure 10:
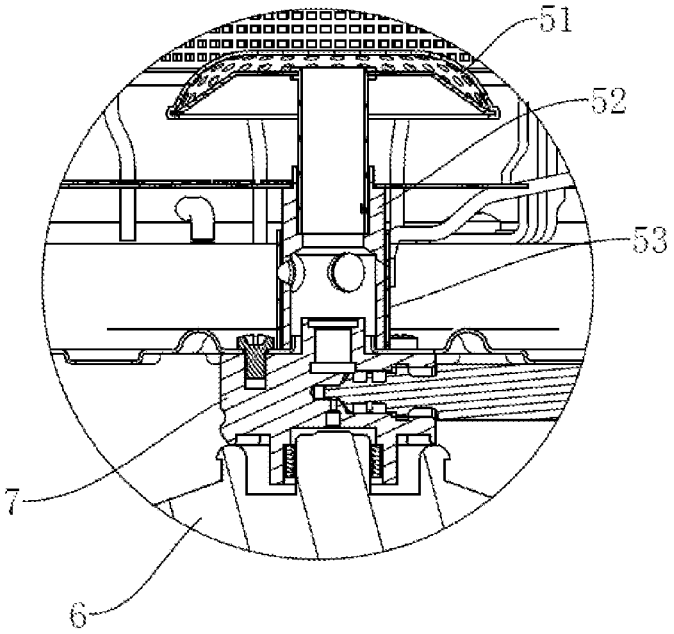
FIG. 10 is an enlarged schematic diagram of B in FIG. 2.
Figure 11:
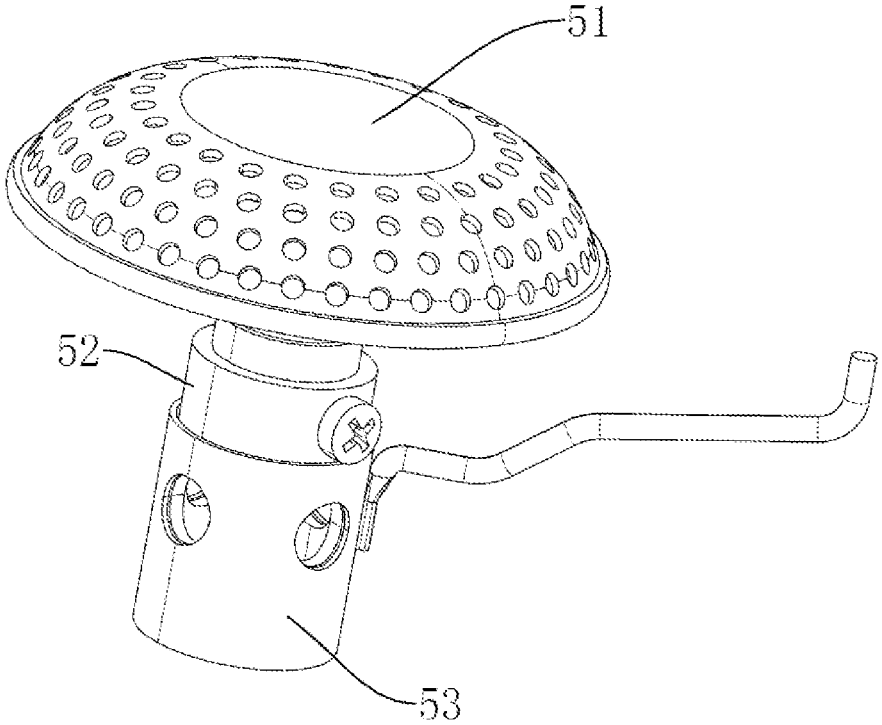
FIG. 11 is a perspective view of a burner assembly of a heater according to one or more embodiments.
Figure 12:
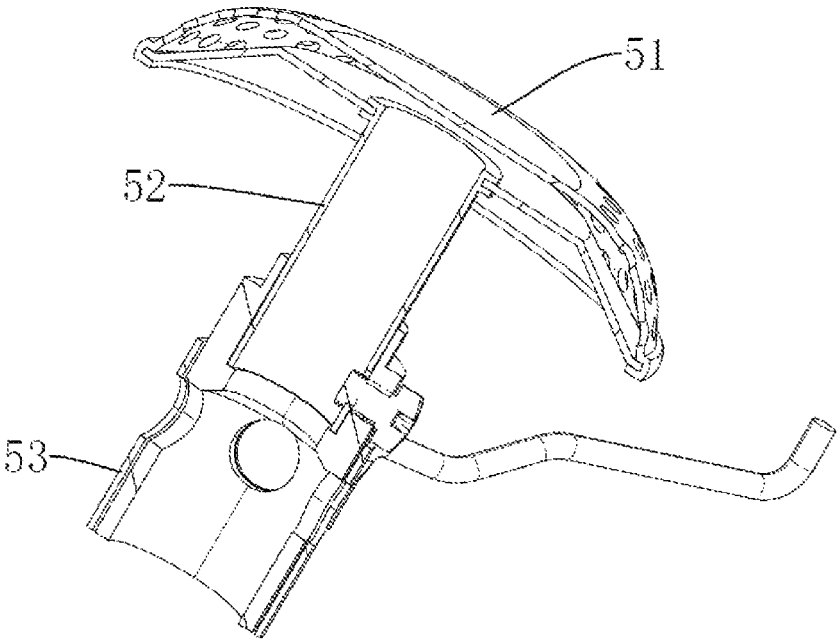
FIG. 12 is a cross-sectional view of a burner assembly of a heater according to one or more embodiments.
Figure 13:
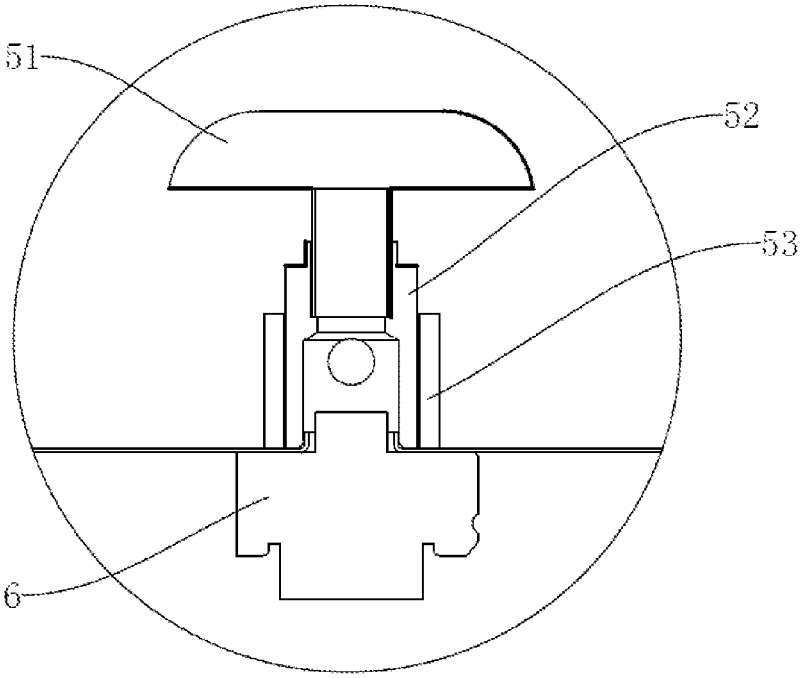
FIG. 13 is a schematic diagram of a gas tank and a burner assembly of a heater according to one or more embodiments.

As shown in FIGS. 3 and 7, the mesh cover assembly 2 includes a cover with a cylindrical structure that is enclosed by a plurality of longitudinal steel bars 22 arranged in an annular array, a bottom ring 21 and an upper ring 20 that both are in a circular ring shape. The upper and lower ends of each set of the steel bars 22, which may be curved or straight, are respectively connected to the bottom ring 21 and the upper ring 20. The limiting assembly limits the position of the mesh cover assembly 2 in a variety of ways. The limiting assembly may be composed of a plurality of sets of L-shaped rotating rods 15 that are pivotally connected to the installation plane 11 of the furnace body 1, and the limiting assembly locks or unlocks the mesh cover assembly 2 by rotation. The rotation positions of the L-shaped rotating rod 15 include a first rotation position and a second rotation position. The L-shaped rotating rod 15 limits the mesh cover assembly 2 from coming out of the furnace body 1 when rotating to the first rotation position, and releases the limit on the mesh cover assembly 2 and allows the mesh cover assembly 2 to come out of the furnace body 1 when rotating to the second rotation position. The installation method of the L-shaped rotating rod 15 to the installation plane 11 is specifically as follows: the L-shaped rotating rod 15 has one end with external threads, the installation plane 11 is provided with the same number of screw holes as the L-shaped rotating rod 15, and the one end of the L-shaped rotating rod 15 is screwed into the screw hole to meet the purpose of rotatability. The L-shaped rotating rod 15 has another end that is opposite to the upper end surface of the furnace body 1 and rotates to a position that intersects an edge of the bottom ring 21, thereby achieving the purpose of limiting the position. The L-shaped rotating rods 15 may be provided in three sets distributed in a ring shape.

In one or more embodiments, the limiting assembly may also comprise at least one set of slotted hole 16 that is fixed on the installation plane 11 and at least one clamping joint 23 that is fixed on the lower end surface of the bottom ring 21 of the mesh cover assembly 2. The clamping joint 23 and the slotted hole 16 are in equal numbers and matched in structure. The clamping joint 23 and the slotted hole 16 are assembled together, so that the mesh cover assembly 2 may be conveniently limited and mounted on the installation plane 11 of the furnace body 1, to meet the purpose of being detachable and not easy to come out when in use. In this embodiment, the slotted holes 16 and the clamping joints 23 are provided in three sets distributed in a ring shape, respectively, and the positions of the slotted holes 16 correspond to those of the clamping joints 23 one to one.

In one or more embodiments, the slotted hole 16 may be gourd-shaped as a whole, and the clamping joint 23 may be T-shaped as a whole. When in use, the clamping joint 23 is extended into the slotted hole 16 and locked after rotation, so as to achieve the limiting purpose of preventing it from coming out.

In one or more embodiments, the slotted hole 16 may also be provided in a circular shape. The outer circumference of the head end of the clamping joint 23 may be provided with external threads. The clamping joint 23 may be fixed by a first fastener after being extended into the slotted hole 16. The first fastener may be a butterfly nut or bolt.

In one or more embodiments, the limiting assembly has an annular groove structure formed by an annular inner recess on the upper end surface of the furnace body 1. The bottom ring 21 of the mesh cover assembly 2, without head-to-tail connection, is embedded into the annular groove structure and clamped by the tension of the mesh cover assembly 2 itself, to prevent the mesh cover assembly 2 from coming out.

As described above, when the heater is in use, the limiting assembly limits the mesh cover assembly 2 on the upper end surface of the furnace body 1. When the heater is packaged, the limiting assembly limits the mesh cover assembly 2 within the cavity. In other words, the structure of the limiting assembly has multiple uses, which can effectively reduce the packaging volume of the heater and facilitate packaging, transportation and carrying.

As shown in FIG. 1, a support assembly 9 is provided above the mesh cover assembly 2. The support assembly 9 includes a fixed plate 91 that is fixedly connected to the upper ring 20 of the mesh cover assembly 2, and an adjusting plate 92 that is located inside the mesh cover assembly 2 and pivotally connected to the fixed plate 91. A heating cover 8 is fixedly provided at the lower end of the adjusting plate 92. Specifically, the fixed plate 91 is fixedly provided with a first hot air hole 93 that penetrates through, and the adjusting plate 92 is fixedly provided with a second hot air hole 94 that penetrates through. The number, position and shape of the first hot air hole 93 match those of the second hot air hole 94. In this embodiment, the first hot air holes 93 and the second hot air holes 94 are arranged in six sets distributed in a ring shape, one set of which is fixedly provided with a push plate 96 on the side wall of the first hot air hole 93. The push plate 96 is inserted upwardly into the first hot air hole 93. The central positions of the fixed plate 91 and the adjusting plate 92 are fixedly provided with a connecting hole, respectively. The third fastener pivotally connects the fixed plate 91 and the adjusting plate 92 through the connecting holes sequentially. The upper end of the fixed plate 91 is also fixedly provided with a supporting block 95 for supporting.

In one or more embodiments, during the implementation process, the heating time may be controlled by the movement of the push plate 96 in the first hot air hole 93. When the push plate 96 moves to the position where the first hot air hole 93 is completely communicated with the inside of the mesh cover assembly 2 through the second hot air hole 94, the heating time is short. As the movement of the push plate 96 in the first hot air hole 93 makes the area where the first hot air hole 93, under the action of the adjusting plate 92, is communicated with the inside of the mesh cover assembly 2 gradually decrease until completely disappears, the heating time gradually increases.

As shown in FIGS. 8-13, the lower end of the burner assembly 5 is fixed on the installation plane 11 and is connected to the gas tank 6 arranged in the cavity via the valve 7. The valve 7 is fixed on the upper surface of the cavity, and the burner assembly 5 is erected on the upper end surface of the furnace body 1. The interface end 61 of the gas tank 6 is connected to the inlet end of the valve 7, which is provided with a sealing ring 71 and connected with the interface end of the gas tank 6 to perform sealing. The burner assembly 5 includes the burner 51 and an ejector tube that is connected to the lower end of the burner 51 and communicated with the interior of the furnace body 1. The outlet end of the valve 7 passes through the installation plane 11. The lower end of the ejector tube of the burner assembly 5 is mounted on the concave surface 12 of the furnace body 1 and forms a gap between its inner wall and the outlet end of the valve 7, so that the heat generated by the burner 51 will not be transmitted to the inlet end of the valve to affect the sealing ring 71, thereby protecting the sealing ring 71 from reduction of the sealing effect due to thermal deformation, and effectively improving the service life of the sealing ring.

In one or more embodiments, the ejector tube includes an inner tube 52 and an outer tube 53 that are nested together. The lower end of the inner tube 52 is fixedly mounted on the concave surface 12 of the furnace body 1, and the upper end is connected to the burner 51. The outer tube 53 may be sleeved on the outer circumference of the inner tube 52 while rotating relative to the inner tube 52. The inner tube 52 and the outer tube 53 are respectively provided with at least one vent 54, so as to make the vent 54 on the inner tube 52 and the one on the outer tube 53 be opposite or staggered or closed by rotating the outer tube 53 to adjust the air intake volume. A rotating rod 55 is fixedly provided on the outer peripheral wall of the outer tube 53 to facilitate the rotation of the outer tube 53. A ceramic sleeve is embedded between the inner tube 52 and the outer tube 53 to enhance the heat insulation effect, thereby improving the protection strength and effect of the sealing ring.

In one or more embodiments, the valve 7 includes a valve body (not illustrated in the figures), a valve core 72 contained in a valve cavity of the valve body, a rotating handle 73 connected to one end of the valve core 72 and extending out of the valve body. The adjustment switch 10 is connected to the rotating handle 73. The inlet end and outlet end of the valve 7 are respectively located on the upper and lower end surfaces of the valve body and communicate with the valve cavity respectively. The valve body is fixedly mounted on the top surface of the cavity by a screw. The upper end of the inner tube 52 is recessed to form a truncated cone-shaped mounting slot (not illustrated in the figures), and the burner 51 has a "T" shape as a whole, with the lower end inserted into the truncated cone-shaped mounting slot and fixed by a second fastener that passes through the side wall of the inner tube 52.

In one or more embodiments, during the implementation process, the heater may further comprise an igniter or an ignition gun for ignition. After the valve 7 is opened and the ignition is operated, LPG (preferably propane) in the gas tank 6 is ejected from the interface end 61 of the gas tank 6 to the inner tube 52 and the outer tube 53 via the valve 7, and then generates fire and heat on the burner 51. Continuous use makes the inner tube 52 generate more heat, and the outer tube 53 may be rotated so that the vent 54 may adjust its air intake for the purpose of adjusting the size of the flame. At the same time, as there is a gap between the outer pipe 53 and the outlet end of the valve 7, no heat conduction will occur therebetween, avoiding the problem of overheating of the valve 7 and the interface end 61 of the gas tank 6, thereby protecting the sealing ring 71 from reduction of the sealing effect due to thermal deformation.

Figure 14:
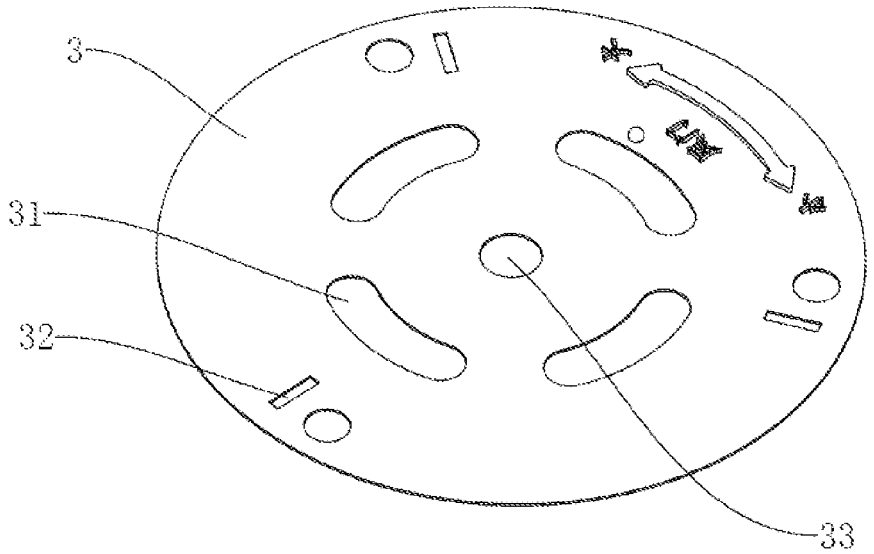
FIG. 14 is a perspective view of a reflecting plate of a heater according to one or more embodiments.
Figure 15:
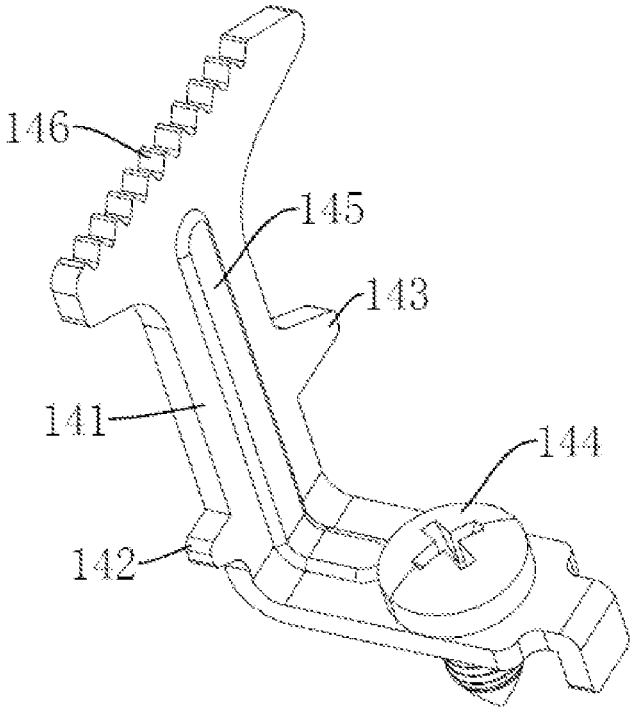
FIG. 15 is a first perspective view of a support frame of a heater according to one or more embodiments.
Figure 16:
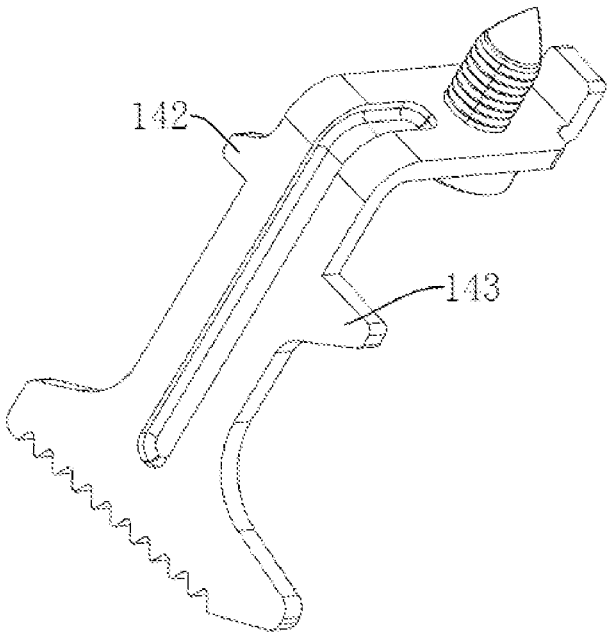
FIG. 16 is a second perspective view of a support frame of a heater according to one or more embodiments.
Figure 17:
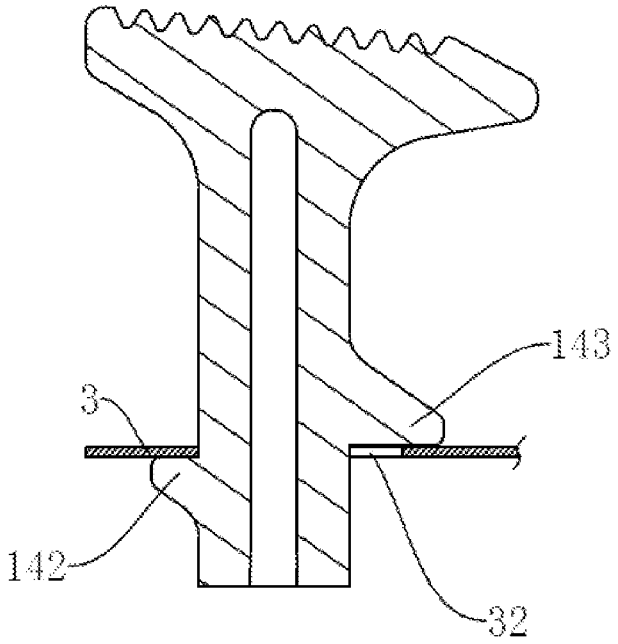
FIG. 17 is an installation diagram of a support frame and a reflecting plate of a heater according to one or more embodiments.

As shown in FIGS. 2 and 14, the reflecting plate 3 is located between the burner assembly 5 and the gas tank 6. The reflecting plate 3 allows the heat generated by the burner 51 to be radiated to the periphery of the interface end 61 of the gas tank 6 while avoiding direct heat radiation to the interface end 61, so as to make the fuel in the gas tank 6 more fully used, avoiding the problems of wasting due to condensation inside the gas tank 6 caused by the low temperature in the gas tank 6, and effectively improving the fuel utilization rate, especially for areas with low air pressure such as plateaus.

In one or more embodiments, the reflecting plate 3 may include a blocking area that includes a projection plane of the burner 51 on the reflecting plate 3 in a longitudinal direction for blocking the heat at the bottom of the burner 51 from being radiated directly to the interface end 61 of the gas tank 6. The reflecting plate 3 may further include a radiation area that does not overlap with the blocking area and allows the heat around the burner 51 to be radiated to the periphery 62 of the interface end of the gas tank 6.

In one or more embodiments, the reflecting plate 3 may be provided with at least one through hole 31 as a radiation area that penetrates longitudinally and does not overlap with the blocking area. The reflecting plate 3 has a circular plate structure as a whole. In this embodiment, the through holes 31 are provided in four sets distributed evenly in a ring shape. The through holes 31 each has an arcuated kidney-shaped slot structure as a whole. The concave surface 12 is fixedly provided with a heat-passing hole 13 that matches the through hole 31. The heat-passing hole 13 and the through hole 31 are in equal numbers, in the same shape, and are opposite in position. The heat-passing hole 13, the through hole 31, and the cavity are communicated to maximize the heat radiation effect.

In one or more embodiments, the center of the reflecting plate 3 may also be provided with a mounting hole 33 for passing through the inner tube 52 of the burner assembly 5.

In one or more embodiments, during the implementation process, the heating cover 8 that is suspended in the mesh cover assembly 2 may have a lower end that faces the through hole 31 and may be located in the periphery of the burner 51. On the one hand, the blocking area of the reflecting plate 3 blocks the heat at the bottom of the burner 51 from being radiated directly to the interface end of the gas tank 6, and the through hole 31 allows the heat near the lower end of the heating cover 8 to directly be radiated to the periphery of the interface end of the gas tank 6 to heat the gas tank. At the same time, due to the higher temperature above the through hole 31 and the lower temperature below the through hole, a bottom-up convection process of cold air is also carried out in the through hole 31, so that a circulation of air flow is formed.

As shown in FIGS. 3 and 15-17, the upper end surface of the furnace body 1 is provided with a support frame 14, which has an L-shaped curved plate structure as a whole, and is mounted on the installation plane 11 through a connecting member 144. The support frame 14 extends inward and outward to form an inner protrusion 143 and an outer protrusion 142, respectively. In the longitudinal direction, the inner protrusion 143 and the outer protrusion 142 are arranged in a staggered manner up and down to clamp the reflecting plate 3, and restrict the support frame 14 from rotating around the connecting member 144 through the reflecting plate 3, thereby enhancing the stability and reliability of the installation structure.

In one or more embodiments, the support frames 14 are provided in three sets distributed evenly in a ring shape. The reflecting plate 3 is provided with a mounting slot 32 for passing through the support frame 14. After the support frame 14 passes through the mounting slot 32, the inner protrusions 143 and the outer protrusions 142 clamp the reflecting plate 3 together, and respectively abut against the upper end surface and the lower end surface of the reflecting plate 3. The inner and outer sides of the main body 141 of the support frame 14 are opposite to the inner and outer walls of the mounting slot 32, respectively. The above configuration advantageously strengthens the stability of the assembly of the support frame 14 and the reflecting plate 3.

In one or more embodiments, the support frame body 141 of the support frame 14 may also be provided with a reinforcing rib 145 to enhance the overall strength. The upper end of the support frame body 141 is formed with a serrated support portion 146 that can increase the strength after the pot is placed. In the horizontal direction, the height of the support portion 146 on the inner side is lower than the height on the outer side, so that the pots can be placed conveniently. In the longitudinal direction, the minimum height of the inner protrusion 143 is higher than the maximum height of the outer protrusion 142, and the lower end surface of the inner protrusion 143 and the upper end surface of the outer protrusion 142 are both arranged horizontally. This makes the reflecting plate 3 more stable after clamping. A screw may be used as the above-mentioned connecting member 144.

In one or more embodiments, a sum of the horizontal width of the support frame body 141 plus the maximum width of the outer protrusion 142 is slightly smaller than the horizontal width of the mounting slot 32 on the reflecting plate 3, and the sum of the horizontal width of the main body of the support frame 14 plus the maximum width of the inner protrusion 143 is slightly larger than the horizontal width of the mounting slot 32 on the reflecting plate 3, so that the reflecting plate 3 may come out of the support frame 14 downwardly rather than upwardly.

As shown in FIG. 1, the heater may further include a handle 17, both ends of which are inserted into the furnace body 1. In addition to the function of carrying the heater and facilitating the movement of the heater, the handle 17 is also used to push the push plate 96 at both ends to avoid burns to the hands.

In one or more embodiments, the first receiving groove 45 is away from the cavity of the furnace body 1, and the fastener is inserted into the first receiving groove 45 and the first screw hole 43 sequentially to fixedly connect the supporting leg 4 and the furnace body 1, that is, the insertion direction of the fastener is the direction from the outside of the furnace body 1 to the cavity. In yet another embodiment, the insertion direction of the fastener is the direction from the cavity of the furnace body 1 to the outside of the furnace body 1. Through the fastening method of the fastener in this embodiment, overall aesthetics is achieved.

Figure 18:
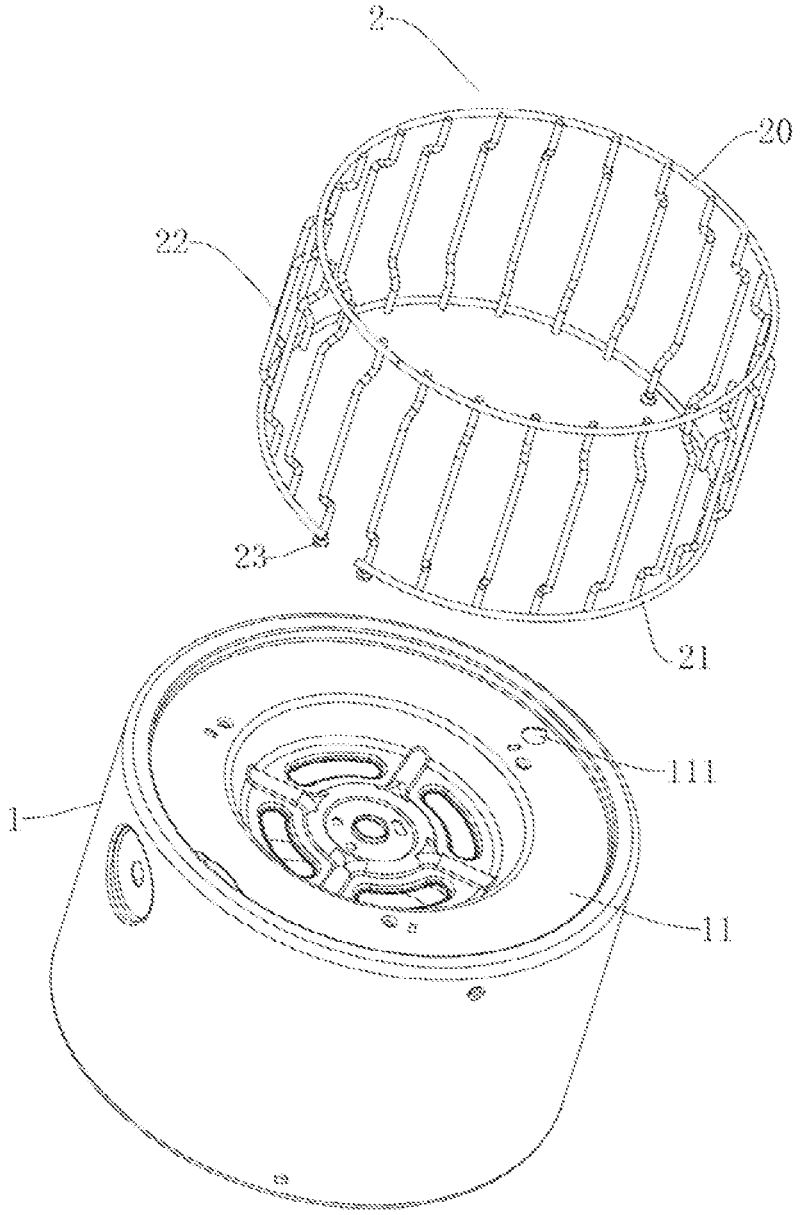
FIG. 18 is an exploded perspective view of a mesh cover assembly and a furnace body of a heater according to one or more embodiments.

In one or more embodiment, the limiting assembly is configured to have an annular groove structure, the bottom ring 21 of the mesh cover assembly 2, without head-to-tail connection, is embedded into the annular groove structure and clamped by a tension of the mesh cover assembly 2 itself to achieve the purpose of limiting the position. In yet another embodiment, as shown in FIG. 18, the bottom ring 21 of the mesh cover assembly 2, without head-to-tail connection, is fixedly provided with the clamping joint 23, the limiting assembly includes an annular groove structure and a hole 111 that matches the clamping joint 23, the bottom ring 21 is embedded in the annular groove and clamped in the annular groove by the tension of the mesh cover assembly 2 itself to achieve the purpose of limiting the position, at the same time, the clamping joint 23 is assembled with the hole 111 to not only position the installation of the mesh cover assembly 2, but also further limit the position of the mesh cover assembly 2 to prevent it from coming out.

In one or more embodiments, the clamping joints 23 are provided in three sets, with two sets fixedly provided at the head and the tail of the bottom ring 21 and the other located in the middle of the bottom ring 21. The positions of the three sets of the clamping joints 23 effectively keep the mesh cover assembly 2 in a stable state when placed alone. The holes 111 and the clamping joints 23 are in equal numbers and match in structure, and the positions of the hole 111 correspond to those of the clamping joints 23 one to one.

In one or more embodiments, the hole 111 may be gourd-shaped as a whole, and the clamping joint 23 may be T-shaped as a whole. When in use, the clamping joint 23 is extended into the hole 111 and clamped through the tension of the mesh cover assembly 2 itself, so as to achieve the limiting purpose of preventing it from coming out upwardly.

In one or more embodiments, the two sets of the holes 111 that are opposite to the two sets of the clamping joints 23 fixed at the head and tail of the bottom ring 21 are communicated.

Figure 19:
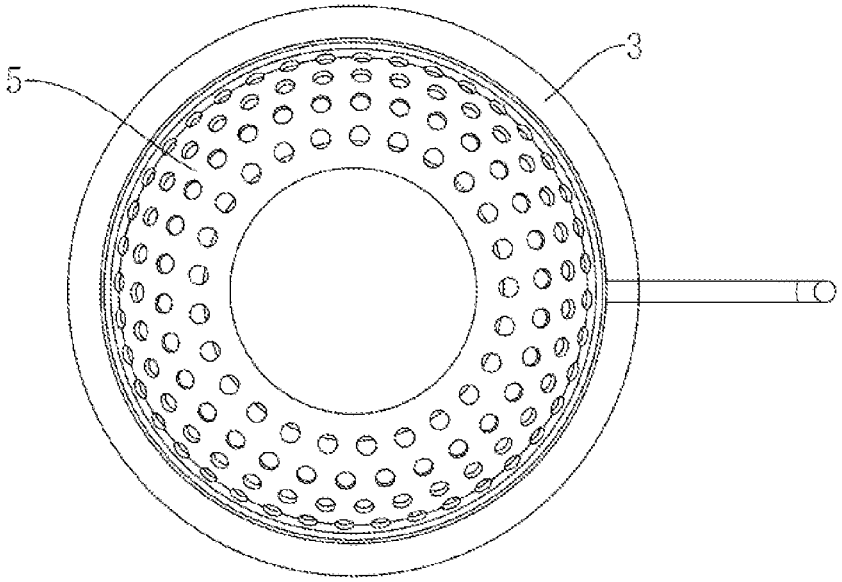
FIG. 19 is a top view of a reflecting plate and a burner assembly of a heater according to one or more embodiments.

In one or more embodiments, as shown in FIG. 19, the reflecting plate 3 has a circular plate structure as a whole, the projection surface of the furnace head 51 on the reflecting plate 3 in the longitudinal direction is completely located in the reflecting plate 3, so as to block the heat at the bottom of the burner 51 from being radiated directly to the interface end of the gas tank 6, the main part of the reflecting plate 3 constitutes the above-mentioned blocking area, and the part outside the outer edge of the reflecting plate 3 constitutes the above-mentioned radiation area.

In one or more embodiments, the projection plane of the burner 51 on the reflecting plate 3 in the longitudinal direction is circular and has a diameter that is not greater than the diameter of the reflecting plate 3, so as to block the heat at the bottom of the burner 51 from being radiated directly to the interface end of the gas tank 6. The projection of the gas tank 6 on the horizontal surface where the reflecting plate 3 is located in the longitudinal direction is circular and has a diameter that is larger than the diameter of the reflecting plate 3, so as to allow the heat in the periphery of the burner 51 to be radiated to the periphery 62 of the interface end of the gas tank 6.

In one or more embodiments, the reflecting plate 3 is mounted on the inner tube 52 of the burner assembly 5, and the plane of the upper end surface of the reflecting plate 3 is in a horizontal position.

Figure 20:
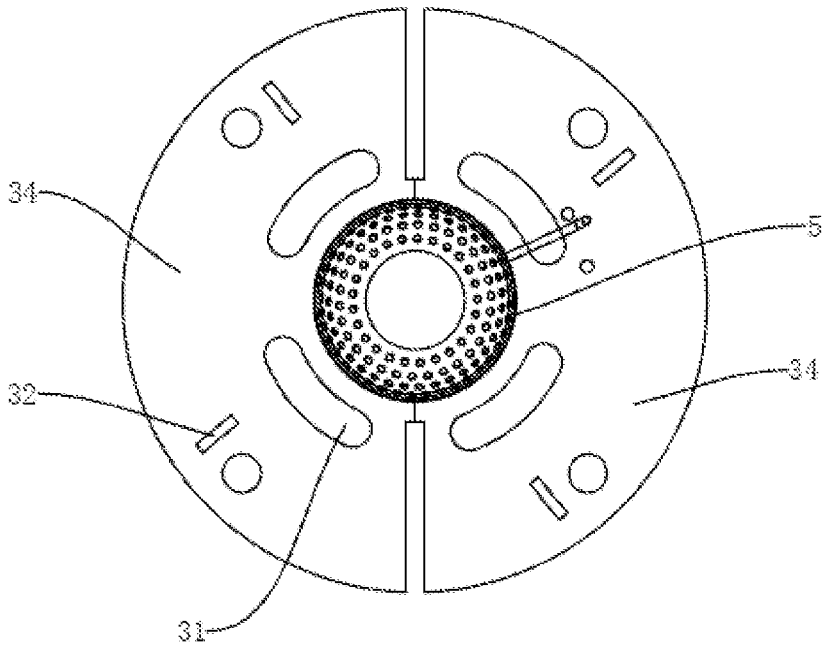
FIG. 20 is a top view of a reflecting plate and a burner assembly of a heater according to one or more embodiments.
Figure 21:
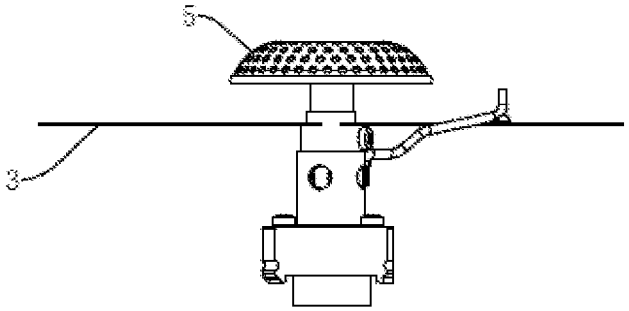
FIG. 21 is a side view of a reflecting plate and a burner assembly of a heater according to one or more embodiments.

In one or more embodiments, as shown in FIGS. 20 and 21, the reflecting plate 3 is composed of a plurality of plates 34 that are located on the same horizontal surface, and at least one plate 34 is provided with a through hole 31 for allowing the heat around the burner 51 to be radiated to the periphery of the interface end of the gas tank 6. The projection surface of the burner 51 on the reflecting plate 3 in the longitudinal direction constitutes the blocking area, and two adjacent plates 34 are seamlessly connected at least in the blocking area, to block the heat at the bottom of the burner 51 from being radiated directly to the interface end of the gas tank 6. The through hole 31 does not overlap with the blocking area.

In one or more embodiments, the reflecting plate 3 has a circular plate structure as a whole. In this embodiment, the through holes 31 are provided in four sets distributed evenly in a ring shape. The through holes each 31 has an arcuated kidney-shaped slot structure as a whole.

In one or more embodiments, the plates 34, arranged in a fan shape, are provided in two sets that are distributed in mirror symmetry. Each set of the plates 34 is provided with a through hole 31.

Figure 22:
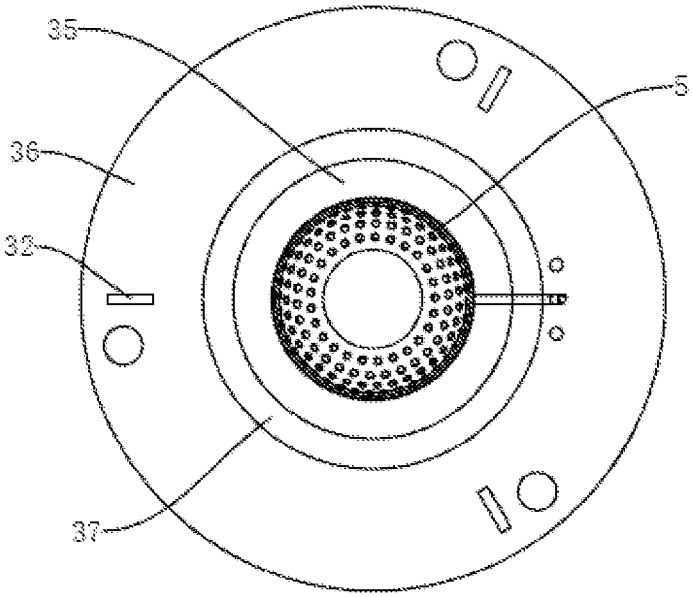
FIG. 22 is a top view of a reflecting plate and a burner assembly of a heater according to one or more embodiments.
Figure 23:
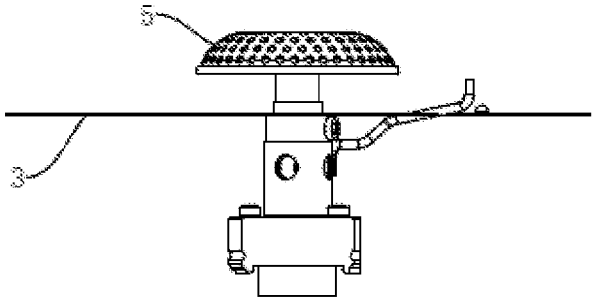
FIG. 23 is a side view of a reflecting plate and a burner assembly of a heater according to one or more embodiments.

In one or more embodiments, as shown in FIGS. 22 and 23, the reflecting plate 3 includes an inner plate 35 and an outer plate 36 that are concentrically arranged, and an annular channel 37 is provided between the inner plate 35 and the outer plate as the above-mentioned radiation area; the projection plane of the burner 51 on the reflecting plate 3 in the longitudinal direction is completely located on the inner plate body 35; the inner plate 35 serves as the above-mentioned blocking area, and the inner plate 35 and the outer plate 36 are located on the same horizontal surface.

Figure 24:
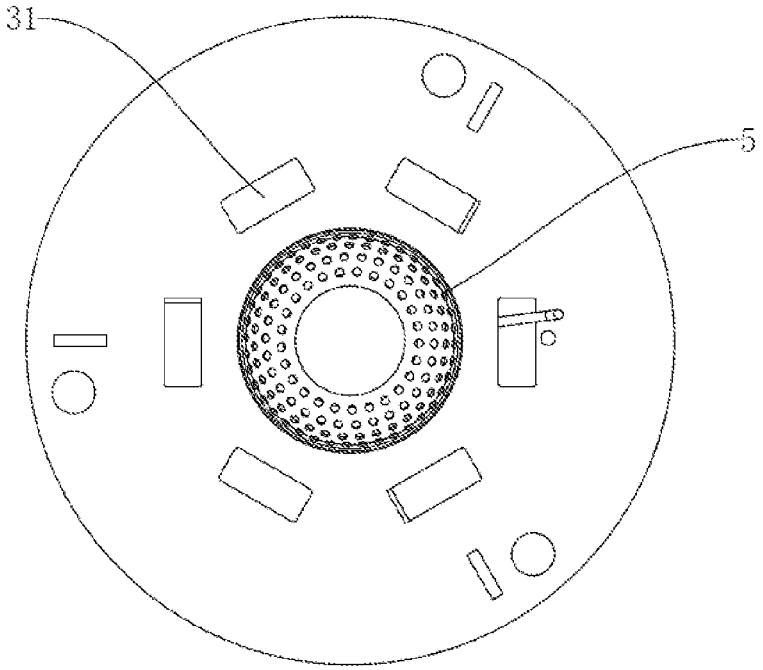
FIG. 24 is a top view of a reflecting plate and a burner assembly of a heater according to one or more embodiments.
Figure 25:
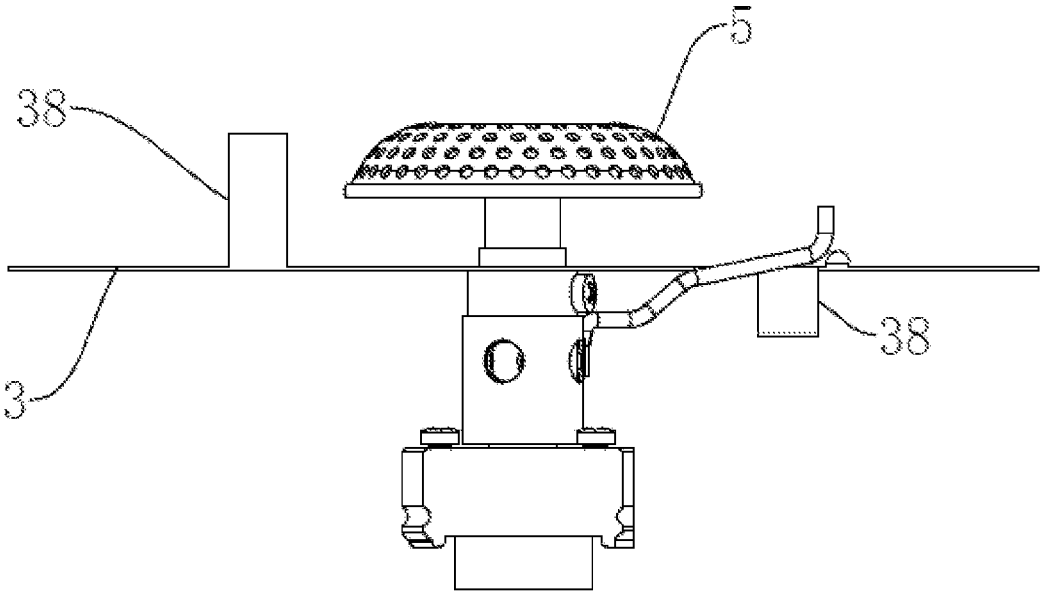
FIG. 25 is a side view of a reflecting plate and a burner assembly of a heater according to one or more embodiments.

In one or more embodiments, the as shown in FIGS. 24 and 25, the through holes 31 have a square groove structure as a whole, and are evenly arranged in the periphery of the blocking area in a ring shape; each set of the through holes 31 is respectively connected to a baffle 38 that is located above or below the reflecting plate 3. The baffle 38 has a substantially rectangular shape, and the sides of the baffle 38 are respectively connected to the edge of the through hole 31; each set of the baffle 38 forms a channel, through which the flow of heat is slowed down, in the horizontal direction with the reflecting plate 3, respectively.

In one or more embodiments, the shape and size of the reflecting plate 3 may be changed according to the overall size and requirements of the reflecting plate, and are not limited thereto.

The embodiments described are only a part of the embodiments of the present invention, rather than all the embodiments. Based on the embodiments of the present invention, all other embodiments obtained by those skilled in the art without doing any creative work fall within the protection scope of the present invention.

What is claimed is:

1. A heater, comprising:

a body;

a burner assembly;

a gas tank; and a reflecting plate, comprises; a blocking area that is a projection plane of the burner on the reflecting plate in a longitudinal direction and prevents the heat that comes from the bottom of the burner from being radiated directly to the interface end of the gas tank; and a radiation area that does not overlap with the blocking area and allows the heat that comes from around the burner to be radiated to the periphery of the interface end of the gas tank, wherein the reflecting plate is provided with at least one through hole, as the radiation area, that penetrates longitudinally and does not overlap with the blocking area wherein the burner assembly is installed on the body, wherein the gas tank is arranged in the body and directly below the burner assembly, wherein the gas tank has an interface end connected to a fuel inlet end of the burner assembly via a valve, wherein the reflecting plate is installed in the body and located between the burner assembly and the gas tank, wherein the body comprises a furnace body and a mesh cover assembly, and wherein the furnace body is provided, at a lower opening, with a cavity for containing the mesh cover assembly.

2. The heater according to claim 1, wherein a lower end surface of the body is provided with a plurality of sets of supporting legs and has an outer peripheral wall that is bent inward to form an annular support surface, wherein an upper end surface of each of the supporting legs has an L-shaped connecting surface comprising a longitudinal surface and a horizontal surface, wherein the longitudinal surface abuts against the annular support surface, wherein the horizontal surface abuts against the outer peripheral wall of the body and is fastened by a screw, and wherein the supporting legs limit a position of the mesh cover assembly contained in the cavity.

3. The heater according to claim 2, wherein the furnace body further comprises a limiting assembly that limits the position of the mesh cover assembly.

4. The heater according to claim 3, wherein the limiting assembly comprises a plurality of sets of L-shaped rotating rods pivotally connected to an upper end surface of the furnace body.

5. The heater according to claim 4, wherein the limiting assembly comprises a plurality of sets of slotted holes arranged on the upper end surface of the furnace body, wherein the mesh cover assembly comprises a bottom ring that is fixedly provided with clamping joints that match the slotted holes, and wherein when the slotted holes have a gourd structure or when the slotted holes are circular, the clamping joints have an outer circumference with external threads, are extended into the slotted holes and screwed with bolts.

6. The heater according to claim 5 wherein the limiting assembly has an annular groove structure formed by an annular inner recess in the upper end surface of the furnace body, and wherein the bottom ring of the mesh cover assembly, without head-to-tail connection, is embedded into the annular groove structure and clamped by a tension of the mesh cover assembly itself.

7. The heater according to claim 6, wherein a bottom ring of the mesh cover assembly, without head-to-tail connection, is fixedly provided with a clamping joint, wherein the limiting assembly includes an annual groove structure and a hole that matches the clamping joint, and wherein the bottom ring is embedded in the annular groove and clamped by the tension of the mesh cover assembly itself, and the clamping joint is assembled with the hole to facilitate installation and positioning of the mesh cover assembly.

8. The heater according to claim 2, wherein the upper end surface of the furnace body comprises an installation plane and a concave surface, wherein the burner assembly has a lower end that is fixed on the installation plane and connected, via the valve, to the gas tank arranged in the cavity, and wherein the concave surface is provided with at least one heat-passing hole that communicates with the cavity.

9. The heater according to claim 8, wherein the installation plane of the furnace body is fixedly provided with a support frame, and wherein the support frame has an upper end that passes through a mounting slot of the reflecting plate and is clamped with the reflecting plate.

10. The heater according to claim 9, wherein the support frame is plate-shaped as a whole, and extends inward and outward to form an inner protrusion and an outer protrusion, respectively, and wherein, in a longitudinal direction, the inner protrusion and the outer protrusion are arranged in a staggered manner to clamp the reflecting plate and restrict a rotation of the support frame.

* * * * *